US009393498B2

(12) United States Patent
Capra

(10) Patent No.: US 9,393,498 B2
(45) Date of Patent: Jul. 19, 2016

(54) PEACEKIN

(71) Applicant: Kevin E. Capra, Englewood, CO (US)
(72) Inventor: Kevin E. Capra, Englewood, CO (US)

( * ) Notice: Subject to any disclaimer, the term of this patent is extended or adjusted under 35 U.S.C. 154(b) by 0 days.

(21) Appl. No.: 14/607,060

(22) Filed: Jan. 27, 2015

(65) Prior Publication Data

US 2015/0209682 A1 Jul. 30, 2015

Related U.S. Application Data

(60) Provisional application No. 61/931,824, filed on Jan. 27, 2014.

(51) Int. Cl.
*A63H 33/26* (2006.01)
*A63H 3/00* (2006.01)

(52) U.S. Cl.
CPC ..... *A63H 3/003* (2013.01)

(58) Field of Classification Search
USPC ..... 446/97, 101, 139, 268, 373, 374, 376, 446/390
See application file for complete search history.

(56) References Cited

U.S. PATENT DOCUMENTS 2,767,517 A * 10/1956 Hooper ..... A63H 33/26 294/65.5
3,409,295 A * 11/1968 Bernstein ..... A63H 13/06 273/239
4,038,775 A * 8/1977 Sato ..... A63H 3/46 403/DIG. 1
4,729,751 A * 3/1988 Schiavo ..... A63H 3/36 446/268
4,801,285 A * 1/1989 Yeu ..... A63H 13/12 446/298
5,362,271 A * 11/1994 Butt ..... A63H 33/26 446/129
5,800,242 A * 9/1998 Clokey ..... A63H 3/04 446/337
6,848,967 B2 * 2/2005 Kim ..... A63H 3/02 446/369
6,887,121 B2 * 5/2005 Whitehead ..... A63H 33/26 446/129
7,943,211 B2 * 5/2011 Chen ..... A47G 33/06 362/121
8,062,088 B2 * 11/2011 Perry ..... A63H 33/046 446/101
9,132,340 B2 * 9/2015 Fish ..... A63F 3/00
2002/0081940 A1 * 6/2002 Schiavo ..... A63H 3/36 446/369
2003/0166374 A1 * 9/2003 Nelson ..... A63H 3/04 446/379
2007/0087651 A1 * 4/2007 Ali ..... A63H 3/50 446/137
2008/0003917 A1 * 1/2008 Norman ..... A63F 9/08 446/97
2008/0026670 A1 * 1/2008 de la Torre ..... A63H 13/06 446/353
2008/0182479 A1 * 7/2008 Elliott ..... A63H 9/00 446/73
2010/0291831 A1 * 11/2010 Yamada ..... A63H 33/26 446/129
2013/0273805 A1 * 10/2013 Leonhardt ..... A63H 3/36 446/390

* cited by examiner

*Primary Examiner* — Kurt Fernstrom

(57) ABSTRACT

A PeaceKin figurine has a three-dimensional head, neck, body, left and right arms, left and right spherical magnet hands, as well as a substantially flat base. The spherical magnet hands allow PeaceKin to attach to one another and appear to "hold hands" without having to interlock any components. PeaceKin can be easily pulled apart simply by pulling a PeaceKin away from another, and then reattached by placing the hands in proximity to each other. When two PeaceKin are facing each other with hands attached, they appear to be hugging because they are slightly leaning forward. When three or more are placed hand-to-hand, they form a circle of PeaceKin, each holding the hands of its neighbors. The PeaceKin can each be customized to appear like a person from a given country, nationality, ethnic group, profession, sports team, holiday costume, historical figure, celebrity, religious figure, archetypal figure, etc.

16 Claims, 9 Drawing Sheets

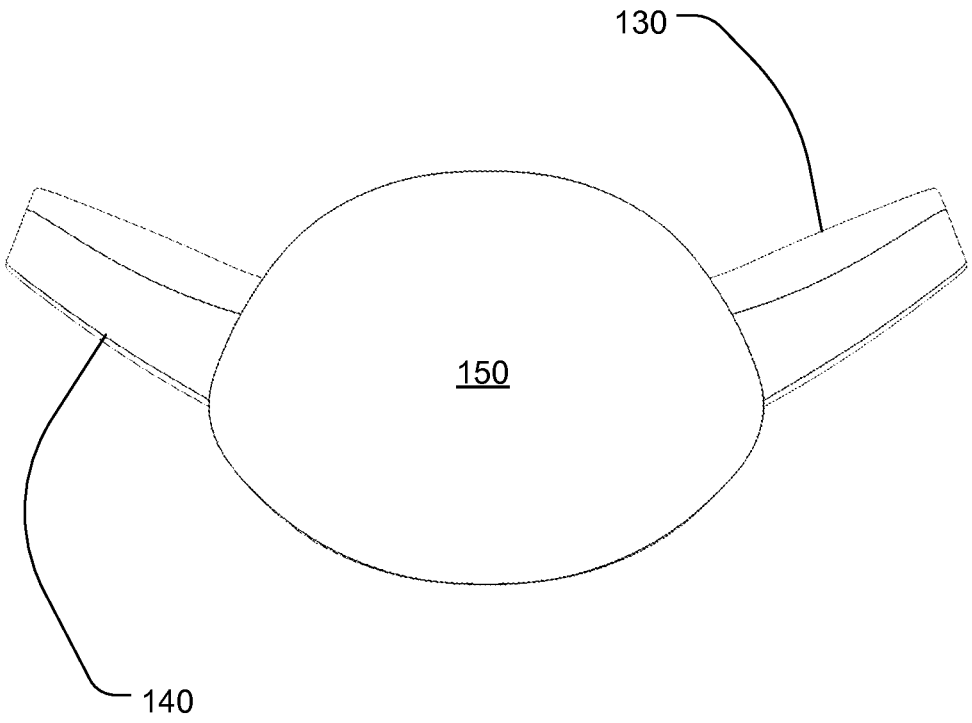
FIG. 8
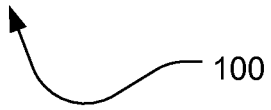

PEACEKIN

CROSS-REFERENCE TO RELATED APPLICATIONS

This application claims the benefit of U.S. Provisional Application No. 61/931,824 entitled PEACEKIN and filed on Jan. 27, 2014, which is specifically incorporated by reference herein for all that it discloses and teaches.

TECHNICAL FIELD

The invention relates generally to the field of dolls and figurines, and more particularly to a three-dimensional, customizable PeaceKin figurine.

BACKGROUND

Some of our oldest archeological explorations of ancient human civilizations have found dolls and figurines and associated artifacts. There are a large number of such items available today as collectibles, children's play items, decorations, etc. Nevertheless, known dolls and figurines are often overly complex, expensive to produce, prone to breakage, and can not easily and simply hold hands with one another. What is needed is a single, easy to produce base figurine that is rugged, can be easily customized based on the owner's preferences (or purchased pre-customized), has arms outstretched in a peace configuration, and yet remains able to hold hands and form a circle with other such figurines.

SUMMARY

One embodiment of the present invention comprises a PeaceKin having a three-dimensional head, neck, body, left arm, right arm, left sphere magnet hand, and right sphere magnet hand, as well as a substantially flat base. The spherical magnet hands allow PeaceKin to attach to one another and appear to "hold hands" without having to interlock any components. Furthermore, the PeaceKin can be easily pulled apart simply by pulling a PeaceKin away from another, and then reattached by placing the hands in proximity to each other. When two PeaceKin are facing each other with hands attached, they appear to be hugging. When three or more are placed hand-to-hand, they form a circle of PeaceKin, each holding the hands of its neighbors. The PeaceKin can each be customized to appear like a person from a given country, nationality, ethnic group, profession, sports team, holiday costume, historical figure, celebrity, religious figure, archetypal figure, any combination of the above, etc. Clothing, hats, accessories, and other paraphernalia can be attached to or worn by a given figurine to further customize each PeaceKin. And yet, the PeaceKin can be placed in a circle and hold hands to show that regardless of their differences, they can find common ground and peaceably join together.

BRIEF DESCRIPTION OF THE DRAWINGS

The aforementioned and other features and objects of the present invention and the manner of attaining them will become more apparent and the invention itself will be best understood by reference to the following descriptions of a preferred embodiment and other embodiments taken in conjunction with the accompanying drawings, wherein:

FIG. 8 illustrates a bottom plan view of an exemplary embodiment of a PeaceKin figurine;

DETAILED DESCRIPTION

Figure 1:
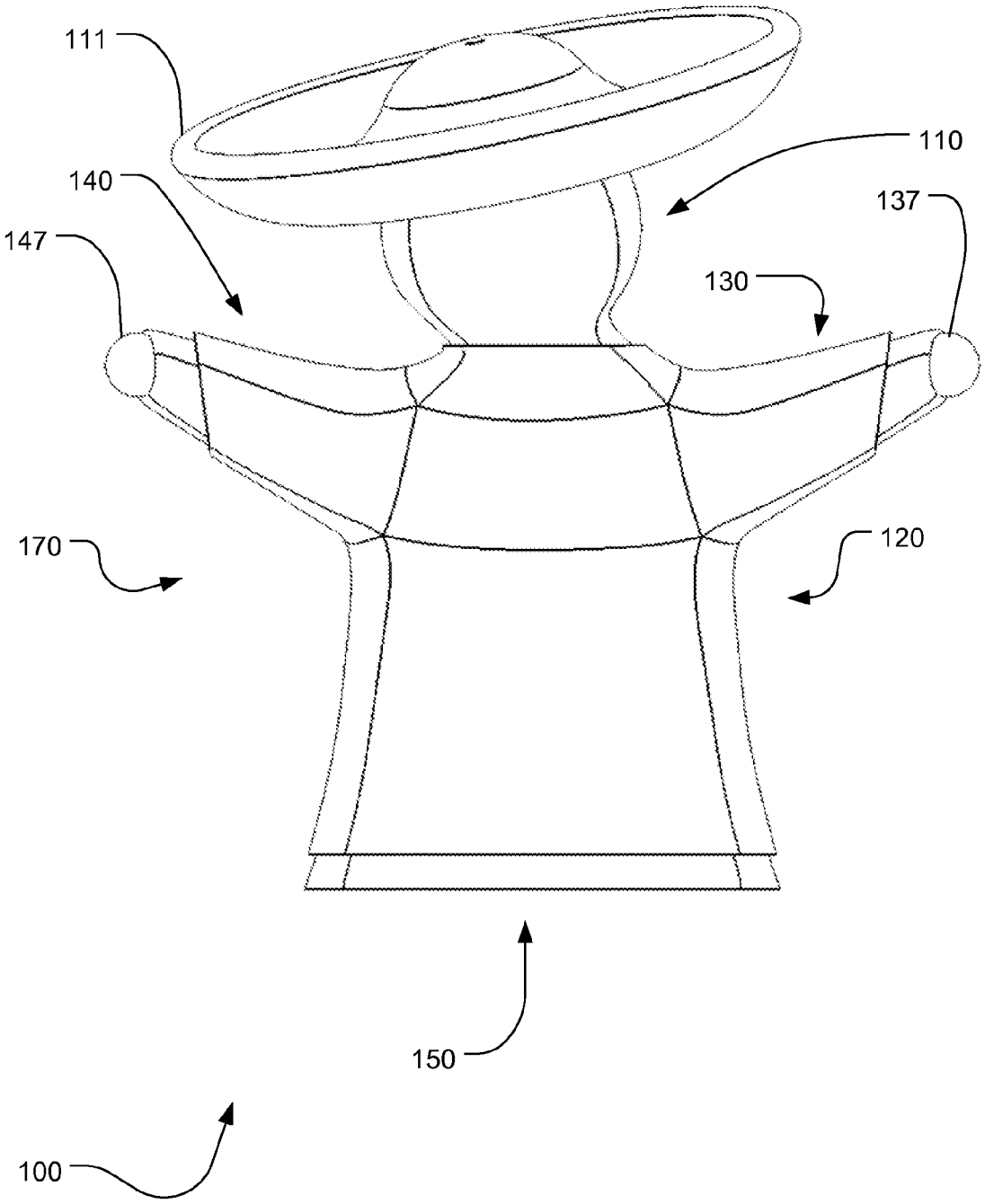
FIG. 1 illustrates a front elevation perspective view of an exemplary embodiment of a PeaceKin figurine in traditional Mexican attire.

In the following discussion, numerous specific details are set forth to provide a thorough understanding of the present disclosure. However, those skilled in the art will appreciate that embodiments may be practiced without such specific details. Furthermore, lists and/or examples are often provided and should be interpreted as exemplary only and in no way limiting embodiments to only those examples.

Exemplary embodiments are described below in the accompanying Figures. The following detailed description provides a comprehensive review of the drawing Figures in order to provide a thorough understanding of, and an enabling description for, these embodiments. One having ordinary skill in the art will understand that in some cases well-known structures and functions have not been shown or described in detail to avoid unnecessarily obscuring the description of the embodiments.

Referring now to the drawings, FIG. 1 illustrates a front elevation perspective view of an exemplary embodiment of a PeaceKin figurine 100 in traditional Mexican attire. The PeaceKin 100 in FIG. 1 has a three-dimensional, somewhat spherical head 110 with headwear 111 (here, a sombrero), and could also have hair, glasses, facial features, etc. In other embodiments, other type of add-ons are contemplated such as different hats, other headwear, various styles/colors/lengths of hair, different/less/more facial features, ears, jewelry, etc. Although not shown in FIG. 1, the head 110 is attached to the main body 120 via a neck (see FIG. 2, item 115).

The PeaceKin figurine 100 in FIG. 1 is sporting custom attire 170. In this example, the custom attire 170 reflects one type of traditional Mexican wear, including a poncho and sombrero. The custom attire 170 comprises clothing and other wearable/customizable items. In other embodiments, other types of custom attire 170 are contemplated (for additional examples, see the custom attire displayed in the Provisional Application referenced above).

Extending generally outwards from the main body 120 of the PeaceKin figurine 100 are the left arm 130 and the right arm 140. The arms 130 and 140 extend outwards and upwards, giving the PeaceKin 100 a friendly "open-arms" appearance. The arms are mostly covered by the custom attire 170 in FIG. 1, so see FIG. 2 for more details. The arms 130 and 140 are positioned so as to provide excellent surfaces upon which to support the custom attire 170. Furthermore, the positioning allows for the hands 137 and 147 to touch the hands of other PeaceKin figurines when placed in proximity. Because of the specific shaping and positioning, two PeaceKins appear to be hugging when placed approximately face to face (instead of the more usual "kissing" arrangement of other prior art figurines).

The left sphere magnet hand 137 and right sphere magnet hand 147 allow PeaceKin figurines to attach to one another and appear to "hold hands" without having to interlock any components. Furthermore, the PeaceKin can be easily pulled apart simply by pulling each PeaceKin away from another, and then reattached by placing the hands in proximity to each other. When two PeaceKin are facing each other with hands attached, they appear to be hugging. When three or more are placed hand-to-hand, they form a line or circle of PeaceKin, each holding the hands of its neighbors. The sphere magnet hands 137 and 147 can be recessed within the ends of the arms 130 and 140 and retained therein by a lip or rim of arm material that extends beyond an equator of the sphere hands 137 and 147. In another embodiment, the hands 137 and 147 are glued or otherwise attached (removably or permanently) to the arms 130 and 140.

At the bottom of the main body 120 is the substantially flat base 150 that supports the PeaceKin 100 and provides a stable base. Unlike many prior art figurines, the PeaceKin 100 does not rely on a pair of legs and feet, so it is inherently much more stable than those figurines that do. Instead, the PeaceKin 100 utilizes a bit of fanciful whimsy by extending the lower trunk somewhat and not utilizing any legs. This configuration allows the PeaceKin 100 to wear custom attire 170 that is normally associated with upper-body/torso only as well as attire that would normally extend all the way down a person's legs to the ground—and everything in between. The surface area of the base 150 can be greater than that of any other horizontal cross-section taken of the main body 120.

Figure 2:
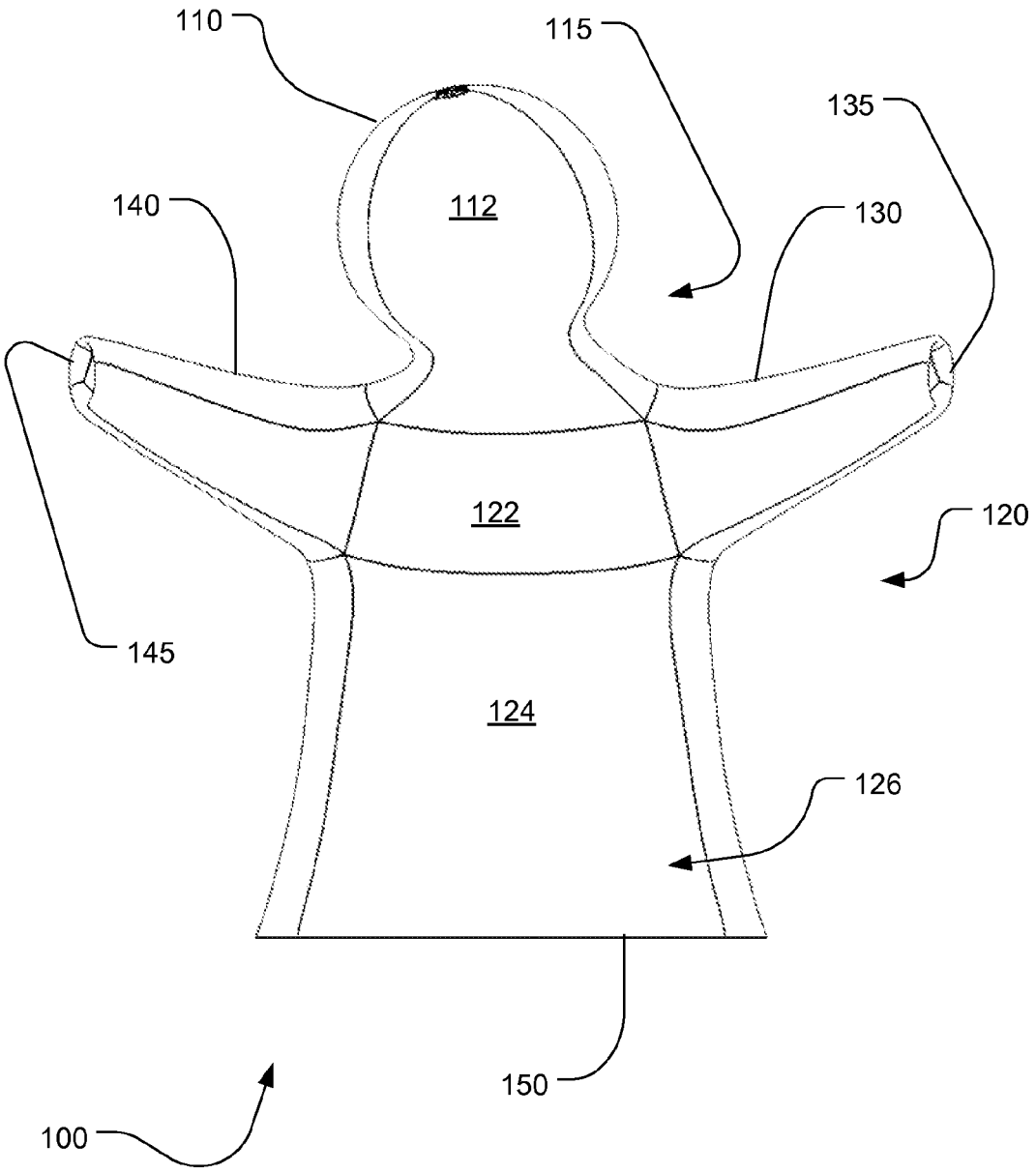
FIG. 2 illustrates a front elevation view of an exemplary embodiment of a PeaceKin figurine.

FIG. 2 illustrates a front elevation view of an exemplary embodiment of a PeaceKin figurine 100. The portions shown in FIG. 2 include the three-dimensional, somewhat spherical head 110, the face 112, the neck 115, the main body 120, the left arm 130, the right arm 140, the left connector 135, the right connector 145, the chest 122, the upper midsection 124, the lower midsection 126, and the base 150.

The face 112 comprises the front portion of the somewhat spherical head 110. A basic PeaceKin figurine 100 does not necessarily have predetermined facial features, as shown in FIG. 2. In another embodiment, features such as eyes, nose, mouth, chin, ears, or others can be included as part of the face 112. In yet other embodiments, facial features can be painted on or otherwise applied to the surface of the face 112 and head 110. The PeaceKin figurine 100 can be made of a material using any single color or mix of colors. Some commonly used colors include white, tan, brown and dark brown.

PeaceKin figurines 100 can be customized by attaching hair and/or headwear. Such accessories can be attached using magnetic means or other attachment means (for example, hook and loop materials).

The neck 115 serves to affix the head 110 onto the body 120. In the PeaceKin 100 shown in FIG. 2, the neck 115 provides a permanent attachment between the other two portions. In other embodiments, the neck 115 can provide a removable attachment to the head 110, body 120, or both.

The arms 130 and 140 extend outwards and upwards from the main body 120, giving the PeaceKin 100 a friendly "open-arms" appearance. The angle between the arms and the main body 120 is greater than ninety degrees and less than one hundred and thirty five degrees. In some embodiments, the arms are mostly covered by custom attire 170 (see, for example, FIG. 1). The arms 130 and 140 are positioned so as to provide excellent surfaces upon which to support the custom attire 170. Furthermore, the positioning allows for the hands (not shown in FIG. 2, see FIG. 1, items 137 and 147) to touch the hands of other PeaceKin figurines when placed in proximity to one another. Although FIG. 2 appears to shown that the right arm 140 is raised to the same height as the left arm 130; this is not necessarily the case in other embodiments (either arm can be somewhat higher than the other). Because of the specific shaping and positioning of the arms, two PeaceKins appear to be hugging when placed approximately face to face.

The left connector 135 and the right connector 145 serve to connect the left and right hands 137 and 147 (see FIG. 1) to their respective arms 130 and 140. As illustrated in FIG. 2, the left and right connectors 135 and 145 comprise sockets that are configured to hold the left and right sphere magnet hands 137 and 147. In another embodiment, the hands comprise eight millimeter spheres. The spheres can both be magnetic, or one can be magnetic and the other can be attracted by a magnet (e.g., a steel ball bearing). In this embodiment, since only one hand is magnetic, the exact orientation of the north and south poles of that magnet are less significant, making construction of the PeaceKin less labor intensive.

The left and right hands 137 and 147 can be attached to the connectors 135 and 145 with adhesives. In another embodiment, acetone is used as it has the added benefit of slightly melting the connectors when certain plastic(s) are used to construct said connectors. The hands 137 and 147 can permanently attach to the connectors, or they can removably attach to the connectors. In one embodiment, the connectors wrap around past a prime meridian of the spherical hands. In such cases, the connectors could be formed around the hands, or the hands could pop into the connectors.

In other embodiments, the connectors 135 and 145 can be hook and loop material, adhesive(s), magnets, or some other form of attachment that secures the hands to the arms.

A front portion of the main body 120 comprises the chest 122, the upper midsection 124 and the lower midsection 126. The chest 122 comprises that portion of the PeaceKin 100 between the neck 115, the arms 130 and 140, and the upper midsection 124. The upper midsection 124 comprises a torso portion and is configured to transition the PeaceKin main body 120 from the chest 122 to the lower midsection 126. The upper and lower midsections 124 and 126 form an elongated torso and can function as a torso without legs, as a torso with somewhat squat legs, or anything in between. This feature provides the PeaceKin with significant versatility such that it can be used to simulate a large variety of human heights, positions, etc. especially when used in combination with custom attire 170.

Although the lower midsection 126 flares outwards to create the wide flat base 150, the PeaceKin 100 are able to appear to hug one another when placed face to face as the main body 120 leans slightly forward and to either the left or right. This allows the hands 137 and 147 to touch and the PeaceKin heads to appear in proximity rather than to stand back in an aloof configuration if the figurines were to stand perfectly straight (in such a case, the forward edges of the lower midsections 126 of two PeaceKin would otherwise be the only point of contact).

Figure 3:
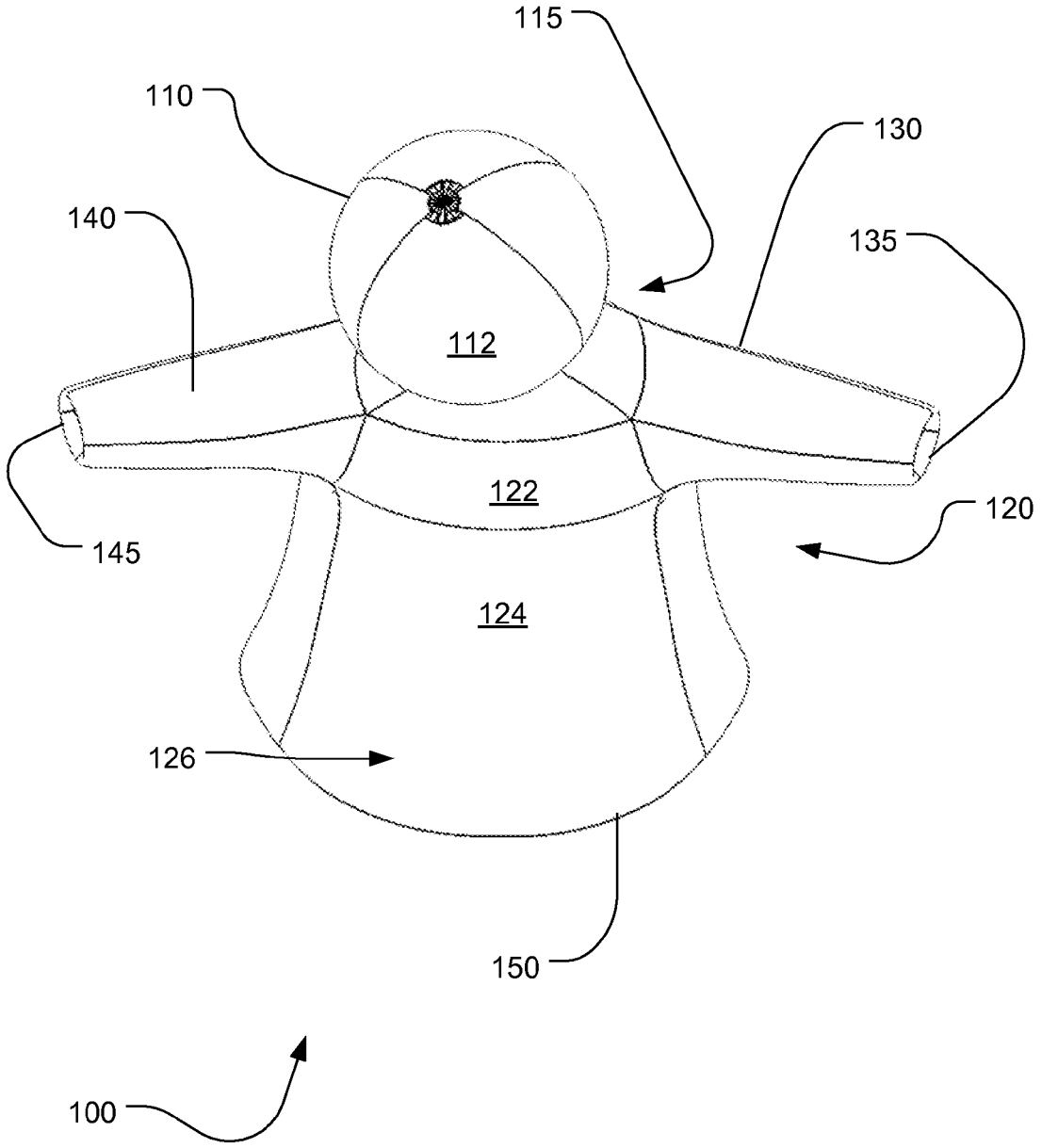
FIG. 3 illustrates a front, top perspective view of an exemplary embodiment of a PeaceKin figurine.

FIG. 3 illustrates a front, top perspective view of an exemplary embodiment of a PeaceKin figurine 100. In this view, the slight forward lean of the PeaceKin is more visible. Also, the positioning of the arms 130 and 140 is further elucidated. The head 110, face 112, neck 115, chest 122, arms 130 and 140, connectors 135 and 145, upper midsection 124, lower midsection 126, main body 120 and base 150 are all identified in this illustration.

Figure 4:
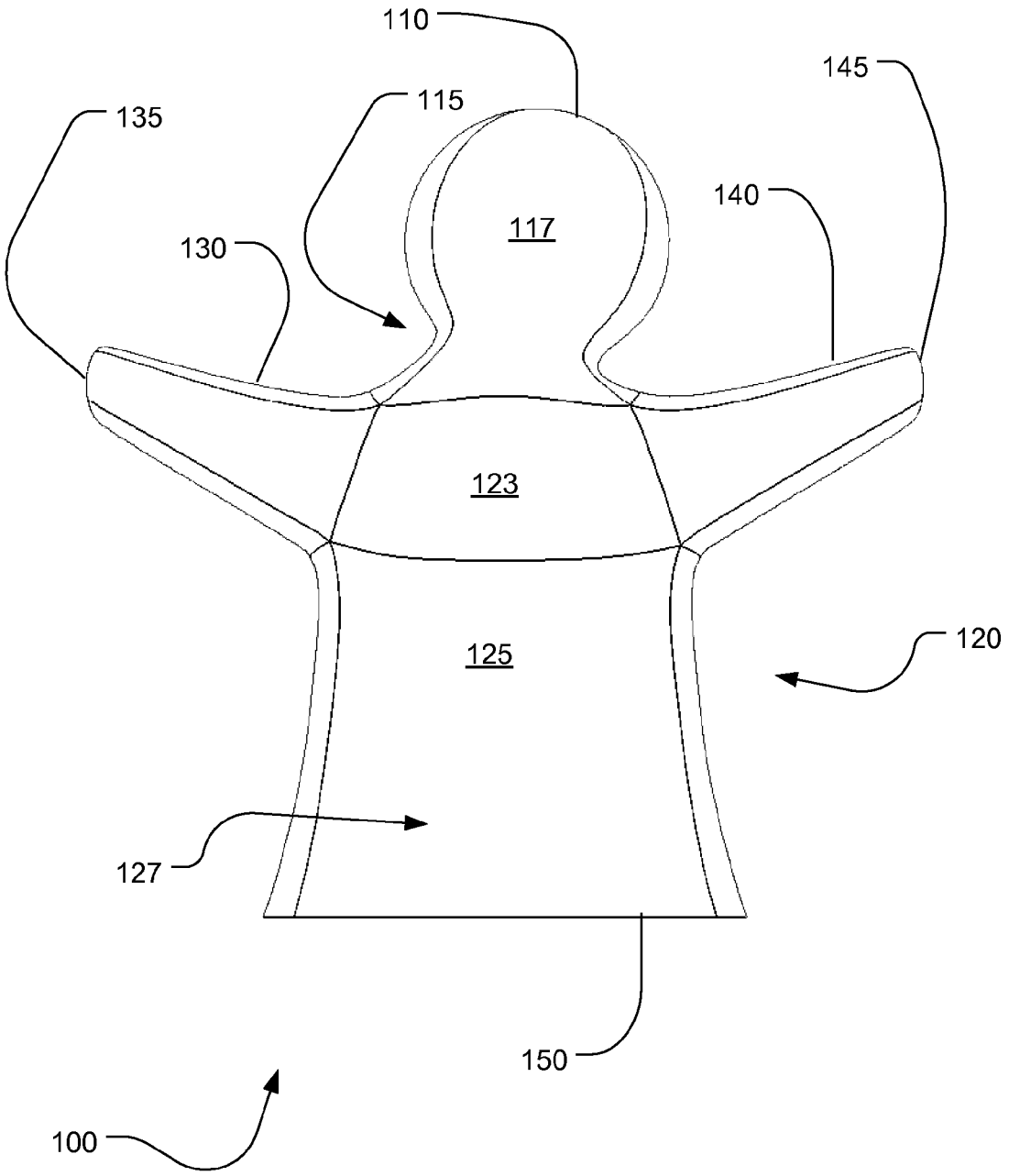
FIG. 4 illustrates a rear elevation view of an exemplary embodiment of a PeaceKin figurine.

FIG. 4 illustrates a rear elevation view of an exemplary embodiment of a PeaceKin figurine 100. The head 110, neck 115, arms 130 and 140, connectors 135 and 145, main body 120 and base 150 are illustrated in this view. Additional components shown here include the back of the head 117, the back 123, the upper back midsection 125 and the lower back midsection 127. The upper and lower back midsections 125 and 127 connect to the back 123; these three components together comprise the rear portion of the main body 120 and correspond to the chest, upper midsection, and lower midsection from the front view (see FIG. 3).

Figure 5:
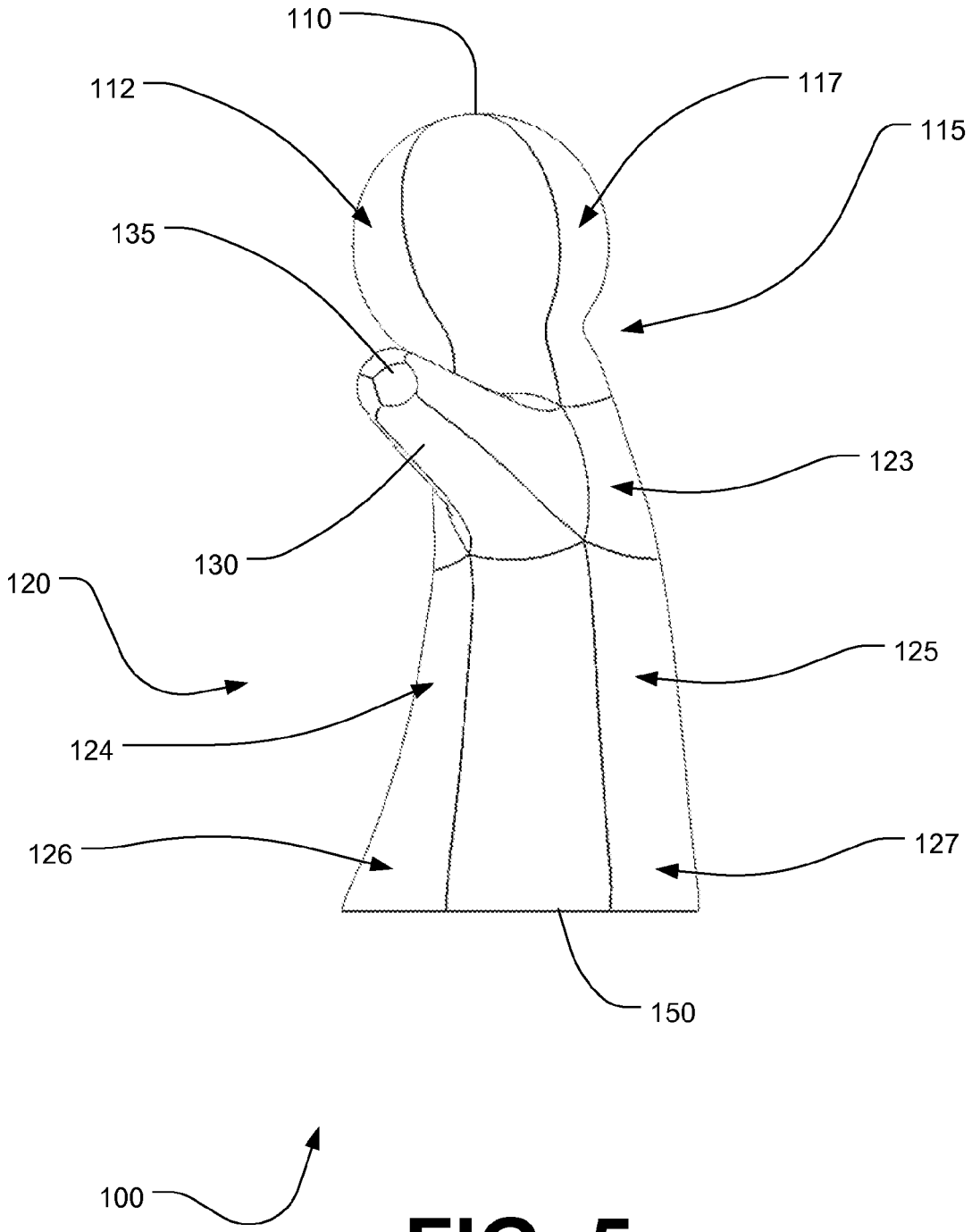
FIG. 5 illustrates a left side elevation view of an exemplary embodiment of a PeaceKin figurine.

FIG. 5 illustrates a left side elevation view of an exemplary embodiment of a PeaceKin figurine 100. The left side junctures between the upper midsection 124 and the upper back midsection 125, and between the lower midsection 126 and the lower back midsection 127 are illustrated. Note also how the arm 130 flares out and upwards from the main body 120.

In the illustration of FIG. 5, the forward lean of the PeaceKin 100 is very apparent. Note that this lean allows the PeaceKin's hands to touch another PeaceKin's hands when the two are placed in a face to face configuration.

Figure 6:
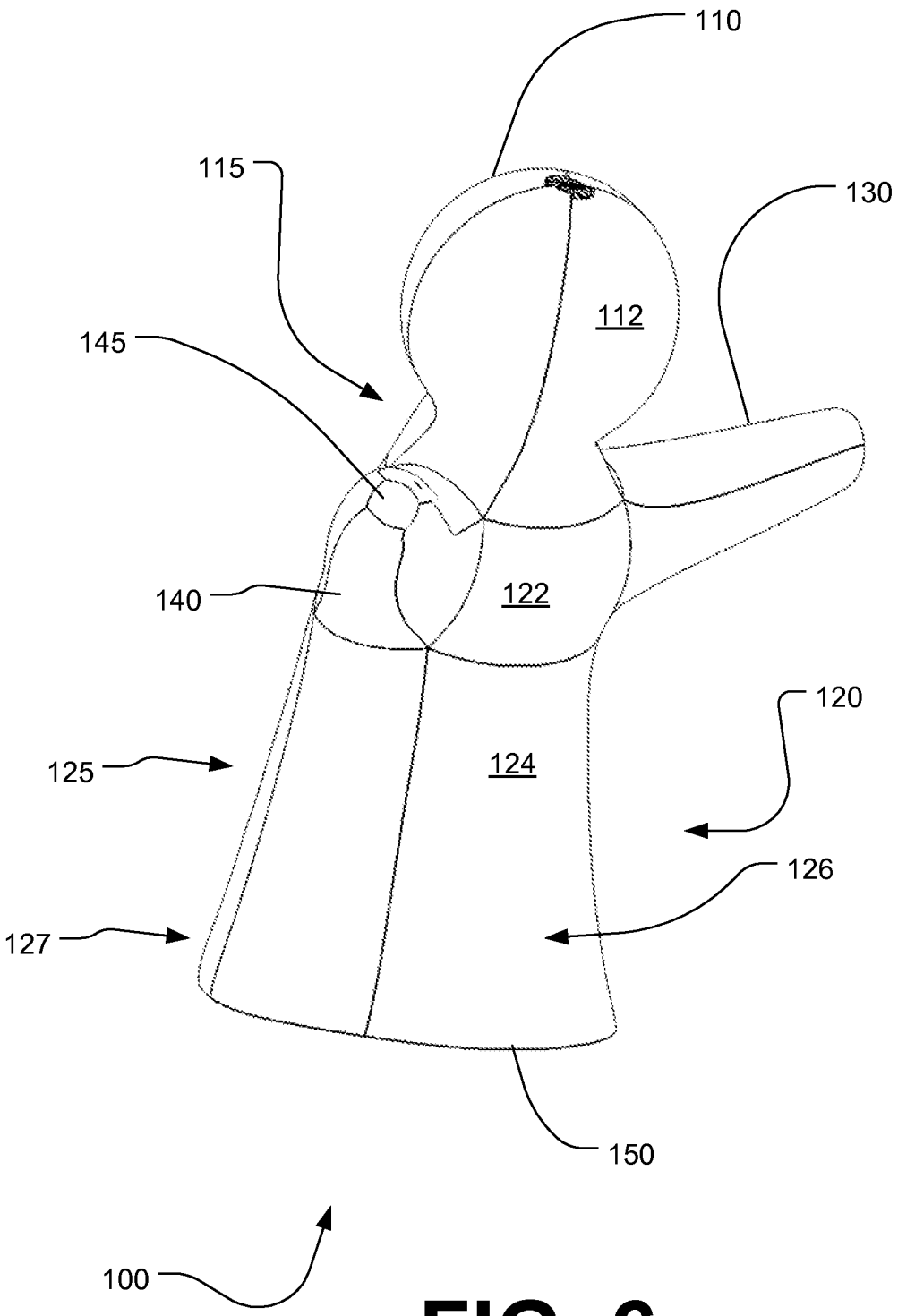
FIG. 6 illustrates a right side perspective view of an exemplary embodiment of a PeaceKin figurine.

FIG. 6 illustrates a right side perspective view of an exemplary embodiment of a PeaceKin figurine 100. The right side junctures between the upper midsection 124 and the upper back midsection 125, and between the lower midsection 126 and the lower back midsection 127 are illustrated. Note also how the arms 130 and 140 flare out and upwards from the main body 120.

In the illustration of FIG. 6, the forward lean of the PeaceKin 100 is also apparent. Note also the socket shape of the connector 145. In other embodiments, the connectors are configured differently.

Figure 7:
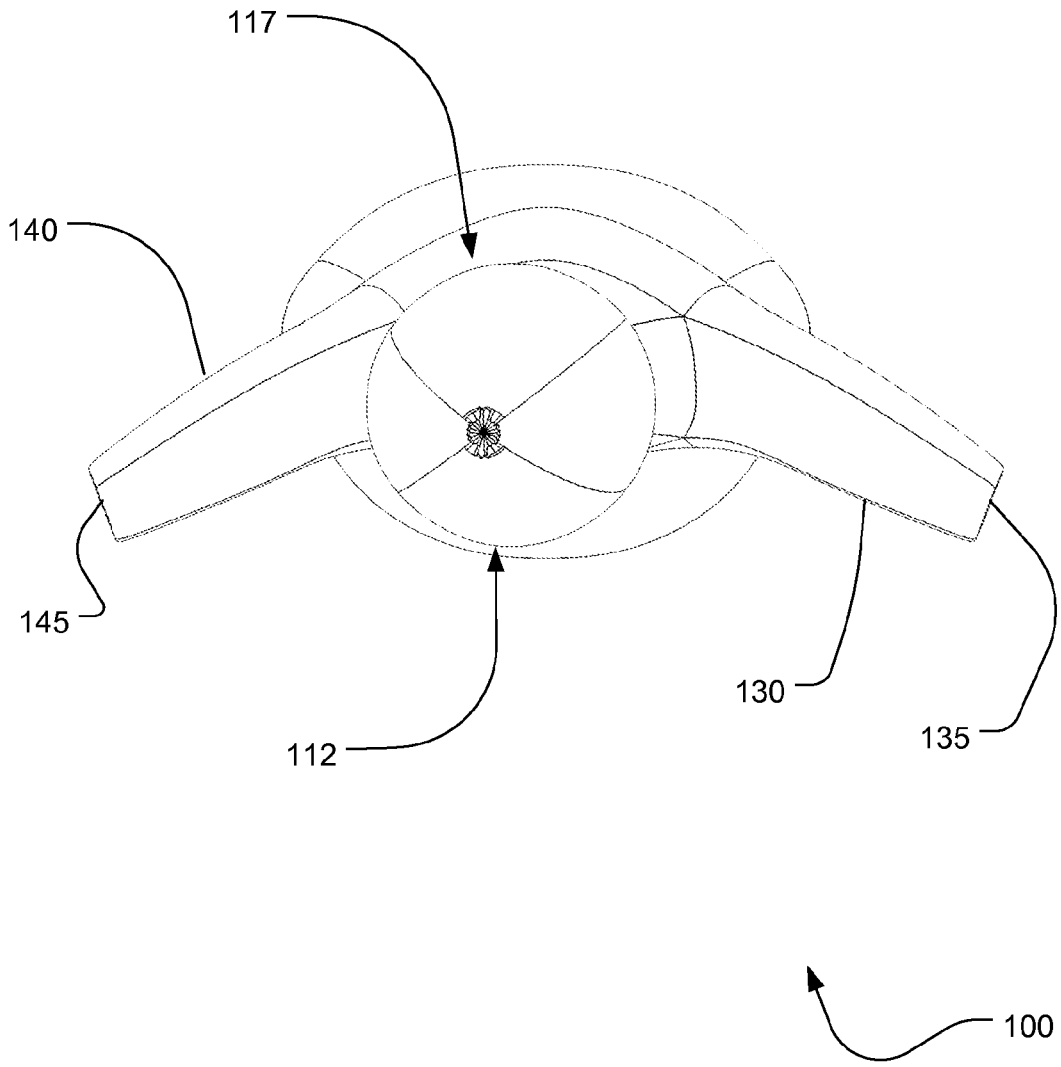
FIG. 7 illustrates a top plan view of an exemplary embodiment of a PeaceKin figurine.

FIG. 7 illustrates a top plan view of an exemplary embodiment of a PeaceKin figurine 100. The placement and configuration of the head 110 is shown, as is the relationship between the face 112 and the back of the head 117. The forward reaching orientation of the arms 130 and 140 is apparent in FIG. 7. This orientation, combined with the forward lean of the PeaceKins allows them to appear to hold hands when placed face to face.

FIG. 8 illustrates a bottom plan view of an exemplary embodiment of a PeaceKin figurine 100. The flat nature of the base 150 is clearly illustrated in FIG. 8. This configuration provides a solid foundation for the PeaceKin 100 so that it can stand firmly and not be easily knocked over. Additionally, the wide base provides stability such that custom attire, headgear, and other accessories can be added to the PeaceKin without causing it to become unstable and tip over. In the embodiment shown in FIG. 8, the flat base 150 is solid. In other embodiments, the base can be hollow, can comprise a lattice-work, or can otherwise comprise girders separated by hollow areas. In yet another embodiment, counterweight can be inserted in the base 150 (or in the interior neat to the base) to ensure the stability of the PeaceKin. This view also shows the forward reaching configuration of the arms 130 and 140.

Figure 9:
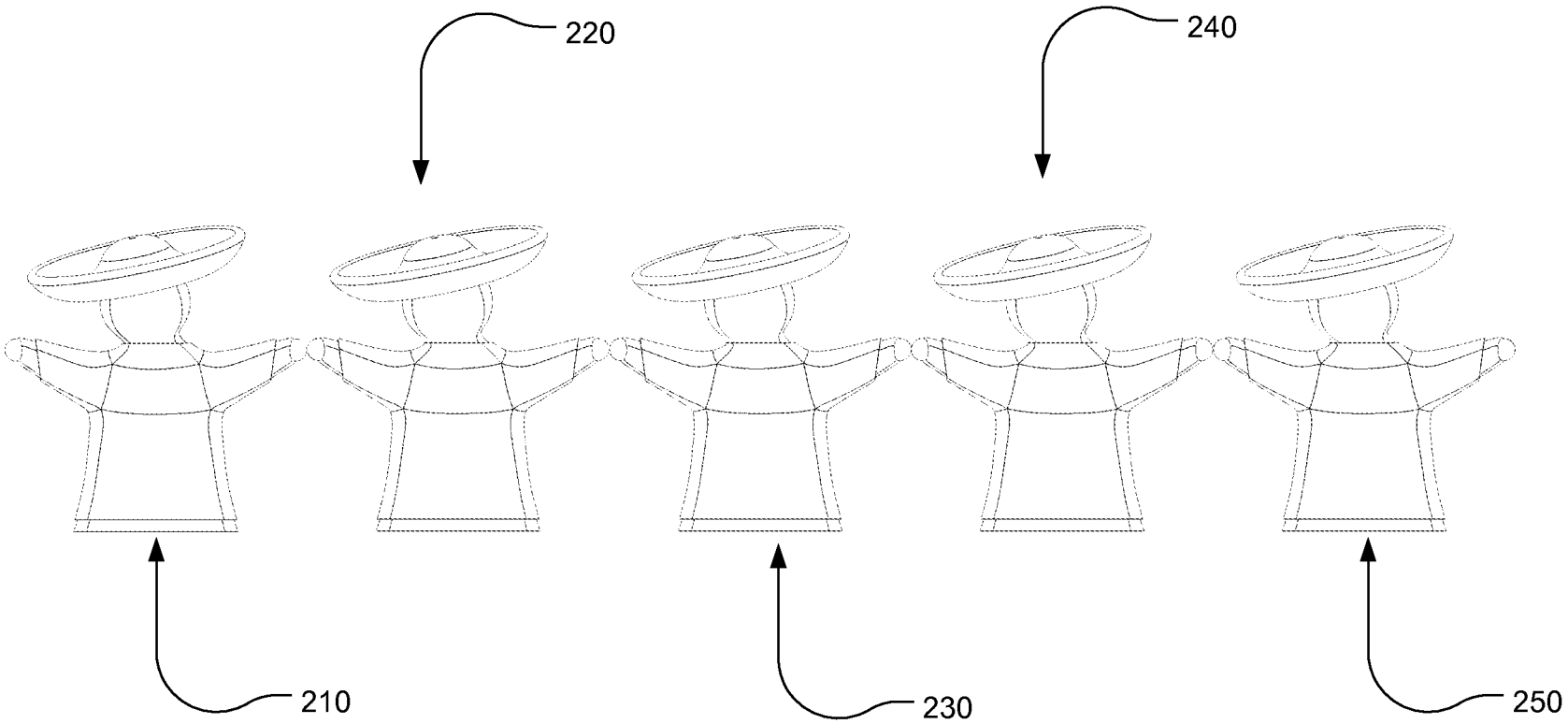
FIG. 9 illustrates a front perspective view of a group of exemplary embodiments of PeaceKin figurines showing them holding hands in a line.

FIG. 9 illustrates a front perspective view of a group of exemplary embodiments of PeaceKin figurines 210, 220, 230, 240 and 250 showing them holding hands in a line. In the embodiment in FIG. 9, the hands of the figurines could be magnetic (magnets and/or materials attracted thereby) so that once placed in proximity to one another, the figurines automatically grasp and hold each others' hands. Although the dress displayed in FIG. 9 is the same in general appearance for all five PeaceKin figurines, 210, 220, 230, 240 and 250, it is contemplated that the clothing and headwear could vary considerably among them. The first figurine 210 could, for example, be dressed as a Chinese girl wearing one form of traditional attire (see Provisional Patent Application 61/931,824, of which this application claims benefit, for examples). The second figurine 220 can, for example, be dressed as a Mexican boy wearing one form of traditional attire. The third figurine 230 can, for example, be dressed as an African boy wearing one form of traditional attire. The fourth figurine 240 can, for example, be dressed as a Native American girl wearing one form of traditional attire. The fifth figurine 250 can, for example, be dressed as a Middle Eastern girl wearing one form of traditional attire. Various types of traditional attire are contemplated, those discussed here are non-limiting examples.

Note that the figurines in FIG. 9 can all hold hands in a line facing forward because of the configuration of the PeaceKin. The free hands of the Chinese Girl 210 and the Middle Eastern Girl 250 can be attached to one another, forming the five PeaceKin figurines into a circle facing either inwards or outwards.

While particular embodiments have been described and disclosed in the present application, it is clear that any number of permutations, modifications, or embodiments may be made without departing from the spirit and the scope of this disclosure.

Particular terminology used when describing certain features or aspects of the embodiments should not be taken to imply that the terminology is being redefined herein to be restricted to any specific characteristics, features, or aspects with which that terminology is associated. In general, the terms used in the following claims should not be construed to be limited to the specific embodiments disclosed in the specification, unless the above Detailed Description section explicitly defines such terms. Accordingly, the actual scope of the claims encompasses not only the disclosed embodiments, but also all equivalent ways of practicing or implementing the claimed subject matter.

The above detailed description of the embodiments is not intended to be exhaustive or to limit the disclosure to the precise embodiment or form disclosed herein or to the particular fields of usage mentioned above. While specific embodiments and examples are described above for illustrative purposes, various equivalent modifications are possible within the scope of the disclosure, as those skilled in the relevant art will recognize. Also, the teachings of the embodiments provided herein can be applied to other systems, not necessarily the system described above. The elements and acts of the various embodiments described above can be combined to provide further embodiments.

Any patents, applications and other references that may be listed in accompanying or subsequent filing papers, are incorporated herein by reference. Aspects of embodiments can be modified, if necessary, to employ the systems, functions, and concepts of the various references to provide yet further embodiments.

In light of the above "Detailed Description," the Inventor may make changes to the disclosure. While the detailed description outlines possible embodiments and discloses the best mode contemplated, no matter how detailed the above appears in text, embodiments may be practiced in a myriad of ways. Thus, implementation details may vary considerably while still being encompassed by the spirit of the embodiments as disclosed by the inventor. As discussed herein, specific terminology used when describing certain features or aspects should not be taken to imply that the terminology is being redefined herein to be restricted to any specific characteristics, features, or aspects of the embodiments with which that terminology is associated.

While certain aspects are presented below in certain claim forms, the inventor contemplates the various aspects in any number of claim forms. Accordingly, the inventor reserves the right to add additional claims after filing the application to pursue such additional claim forms for other aspects.

The above specification, examples and data provide a description of the structure and use of exemplary implementations of the described articles of manufacture and methods. It is important to note that many implementations can be made without departing from the spirit and scope of the invention.

What is claimed is:

1. A PeaceKin figurine, comprising:

a generally spherical head attached via a neck to a main body;

the main body comprising a front portion having a chest, upper midsection and lower midsection and a rear portion having a back, upper back midsection and lower back midsection;

a left arm extending outwards and upwards from a left side of the PeaceKin figurine, at approximately a left side juncture between the chest and the back;

a right arm extending outwards and upwards from a right side of the PeaceKin figurine, at approximately a right side juncture between the chest and the back;

a left spherical hand attached to the left arm via a left connector and a right spherical hand attached to the right arm via a right connector;

a substantially flat base forming an underside of the main body and adapted to provide a foundation for the PeaceKin figurine;

an average exterior perimeter of horizontal cross-sections gradually increasing from the upper midsection to the base; and wherein at least one of the left spherical hand and the right spherical hand is magnetic.

2. The PeaceKin figurine of claim 1, further comprising:

wherein the main body is adapted such that the PeaceKin figurine is leaning forward so that the left spherical hand is at approximately the same height as the second right spherical hand such that if two PeaceKin figurines are placed facing each other, the left hands and the right hands contact one another.

3. The PeaceKin figurine of claim 1, further adapted so that when a first PeaceKin figurine and a second PeaceKin figurine are placed facing each other and in contact with each other, the first and second PeaceKin figurines appear to be hugging each other.

4. The PeaceKin figurine of claim 2, further adapted so that when a first PeaceKin figurine and a second PeaceKin figurine are placed facing each other and in contact with each other, the first and second PeaceKin figurines appear to be hugging each other.

5. The PeaceKin figurine of claim 1, further adapted so that custom attire can be placed on the PeaceKin figurine.

6. The PeaceKin figurine of claim 2, further adapted so that custom attire can be placed on the PeaceKin figurine.

7. The PeaceKin figurine of claim 3, further adapted so that custom attire can be placed on the PeaceKin figurine.

8. The PeaceKin figurine of claim 4, further adapted so that custom attire can be placed on the PeaceKin figurine.

9. The PeaceKin figurine of claim 1 further adapted such that three or more PeaceKin Figurines can be magnetically connected to one another by the spherical hands to form a circle.

10. The PeaceKin figurine of claim 2 further adapted such that three or more PeaceKin Figurines can be magnetically connected to one another by the spherical hands to form a circle.

11. The PeaceKin figurine of claim 3 further adapted such that three or more PeaceKin Figurines can be magnetically connected to one another by the spherical hands to form a circle.

12. The PeaceKin figurine of claim 4 further adapted such that three or more PeaceKin Figurines can be magnetically connected to one another by the spherical hands to form a circle.

13. The PeaceKin figurine of claim 5 further adapted such that three or more PeaceKin Figurines can be magnetically connected to one another by the spherical hands to form a circle.

14. The PeaceKin figurine of claim 6 further adapted such that three or more PeaceKin Figurines can be magnetically connected to one another by the spherical hands to form a circle.

15. The PeaceKin figurine of claim 7 further adapted such that three or more PeaceKin Figurines can be magnetically connected to one another by the spherical hands to form a circle.

16. The PeaceKin figurine of claim 8 further adapted such that three or more PeaceKin Figurines can be magnetically connected to one another by the spherical hands to form a circle.

* * * * *